United States Patent [19]

Dürr

[11] Patent Number: 5,003,731

[45] Date of Patent: Apr. 2, 1991

[54] BELT CONVEYOR SYSTEM FOR A CONVEYOR BELT FASHIONED AS A BRAIDED WEB

[75] Inventor: Dieter Dürr, München, Fed. Rep. of Germany

[73] Assignee: Linde Aktiengesellschaft, Wiesbaden, Fed. Rep. of Germany

[21] Appl. No.: 439,986

[22] Filed: Nov. 21, 1989

[30] Foreign Application Priority Data

Nov. 22, 1988 [DE] Fed. Rep. of Germany ..... 3839380

[51] Int. Cl.[5] ..... B24C 3/08

[52] U.S. Cl. ..... 51/418; 198/833; 209/307

[58] Field of Search ..... 51/418; 198/833; 209/307, 403

[56] References Cited

U.S. PATENT DOCUMENTS 2,019,389 10/1935 Bogaty .
2,076,506 4/1937 Sibon et al. .
2,244,422 6/1941 Guba .
4,179,025 12/1979 Piette et al. ..... 198/833
4,254,710 3/1981 Guay ..... 198/833 X
4,476,655 10/1984 Ansbaugh ..... 51/418 X
4,535,894 8/1985 Shell ..... 209/307 X

FOREIGN PATENT DOCUMENTS 1207616 12/1965 Fed. Rep. of Germany .
178666 11/1982 Japan ..... 51/418

*Primary Examiner*—James G. Smith
*Attorney, Agent, or Firm*—Millen, White & Zelano

[57] ABSTRACT

A belt conveyor system comprises a conveyor drive and support and a conveyor belt fashioned as a braided web. In order to be able to utilize, independently of the conveyor drive and support any desired braided webs for transporting any desired items in varying temperature ranges, the conveyor drive is made of parallel chains joined together by crossbars. The braided web is placed thereon and connected to the crossbars by entraining dogs configured as combs.

9 Claims, 3 Drawing Sheets

BELT CONVEYOR SYSTEM FOR A CONVEYOR BELT FASHIONED AS A BRAIDED WEB

BACKGROUND OF THE INVENTION

The invention relates to a belt conveyor system with a conveyor belt fashioned as a braided web. Such belt conveyor systems are utilized for separating small items from large items, the small items dropping through meshwork of the braided material. The small items can be, for example, residues of casting fins and abrasive media produced during the blasting of cast or injection-molded shaped components.

It is known to advance braided web belt conveyor systems by frictional engagement of the braided web with rotating rolls. However, there is a disadvantage in these systems in that they have problems when used in differing temperature ranges because the friction coefficient between the braided bands and rolls is subject to strong fluctuations. As a result, positive transmission of motion from the rolls to the braided band is not ensured. The friction coefficient can be too small, especially at low temperatures which occur, for example, during deburring of synthetic resin or rubber moldings. This is because the braided band and the rolls generally consist of a metal since friction-enhancing rubber layers cannot be used since rubber becomes brittle at low temperatures.

It is also known to transport such braided bands in a shape-mating fashion. This can be done with wire mesh belts by welding metallic link-type chains to the edges of the belts and driving the chains with chain pinions. The chains thus are an integral component of the braided band. As a result there is the drawback, on the one hand, that the braided band is restricted to a specific drive mechanism; and on the other hand, there is a considerable increase in the cost of the braided band. Furthermore, the weld bonds between the chains and the braided band are subject to fatigue which can lead to unforeseen rupture.

This problem does not arise in conveyor belts consisting of two parallel chains joined by long pins where the pins are connected with one another by special elements. However, such conveyor belts are expensive and complicated to manufacture, as contrasted to braided belts. Furthermore, the interstices within the band exhibit, as a result of the inherent structure, a specific minimum size so that such bands cannot be utilized for all purposes. For example, they cannot be used for small moldings.

SUMMARY OF THE INVENTION

The invention has as an object avoiding the aforementioned drawbacks and of creating a belt conveyor system with a conveyor belt fashioned as a braided web in an economical way, making it possible, independently of the conveying device, to provide any type of braided webs or bands for the conveyance of any types of items in varying temperature ranges.

This object and other objects have been attained according to the invention by having the braided web rest on a revolving conveying means consisting of parallel chains joined by a plurality of crossbars. The braided web is connected to the conveying means in a shape-mating fashion by entrainment means attached to the crossbars, these entrainment means engaging into the braided band. Thus, a shape-mating transport of the braided band is effected, and functions at all temperature ranges. The shape-mating connection is attained by dogs fitted to the interstices of the braided web and extending into these interstices. Therefore, any desired braided web can be utilized. The conveyor means proper is independent of the type of structure of the braided web and of the dimensions of the latter, and therefore, in principle, can be freely designed. Only the entrainment means, i.e., the connecting elements between conveyor means and braided webs, must be correspondingly adapted.

Such a conveyor system can be utilized for the conveyance of items in a hot environment, for example, a hardening shop, as well as for the transport of items in a cold environment, for example, a cryogenic atmosphere such as that occurring in a food cooling tunnel and in a deburring facility for items to be embrittled under cold conditions. The braided web is supported along its entire breadth by rugged crossbars so that the load exerted on the web is decreased and its lifetime is lengthened. Furthermore, the mesh size remains constant.

The advantageous design of the entrainment means as a series of combs permits an especially solid and favorable, shape-mating force transmission between the crossbars of the conveyor means and the braided web. The spaces between individual tines of the combs and their cross-section are adapted to the mesh with interstices in the braided band. By arranging, according to an advantageous further development of the subject of this invention, a plurality of entrainment means or combs on each of the crossbars provided for the mounting of entrainment means or combs at mutual spacings, uniform force transmission is attained to the braided band, and therefore uniform movement ensues.

In another advantageous embodiment, the braided web consists of wire mesh and the crossbars are made of metal, especially a weldable metal. In this embodiment, the entrainment means are welded to the crossbars as well as to the braided band, resulting in a rugged joint of wire mesh and conveyor means.

It is especially advantageous to utilize such a conveyor belt system for a troughed-belt abrasive blast deburring facility, particularly if such a facility serves to deburr rubber and synthetic resin components by cold embrittlement and blasting. The use of such a troughed-belt, abrasive blast deburring facility occurs at a temperature range where it is advantageous for the braided web and the conveyor means to be joined in a shape-mating fashion.

BRIEF DESCRIPTION OF THE DRAWINGS

The invention will be described in detail below with reference to the examples shown in the schematic figures wherein.

DETAILED DESCRIPTION

Figure 1:
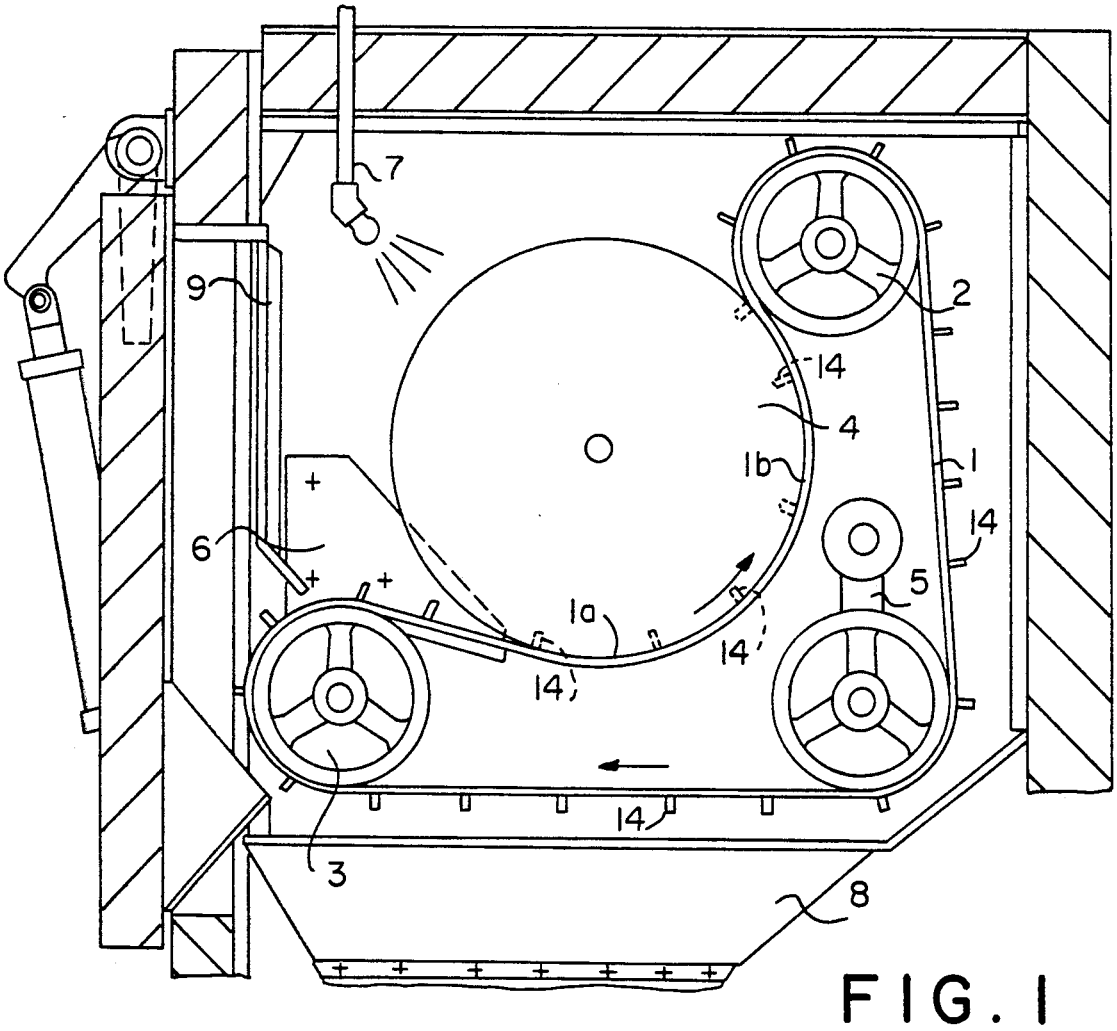
FIG. 1 is a side view partially in section showing a troughed-belt, abrasive blast deburring facility.

Referring now to FIG. 1, a looped conveyor belt in the form of a braided web 1 rests with one of its peripheral edges on a drive wheel 2 and a track wheel 3. A trough wheel arrangement 4 provides a trough between a pair of relatively thin trough wheels which are independently journaled. The trough is defined by a horizontal web section 1*a* and a vertical web section 1*b* of the conveyor belt 1. A tensioning device 5 serves for longitudinal compensation of the braided web 1. The braided web 1 initially advances around the wheels in the clockwise direction, and moldings (not shown in the figure) which are disposed on the horizontal length of the web are turned over by partial upward transport onto the vertical web length. The aforementioned wheels are provided as pairs in each case, namely along the two peripheral edges of the braided band 1. A lateral baffle 6 prevents, in conjunction with the design of the trough wheel 4 as a peripheral, grooved, solid disk, moldings along the edges of the braided web 1 from dropping from the latter during the turning over step. By means of a spray unit 7, cold gas is introduced into the troughed-belt abrasive blast facility, leading to embrittlement of the moldings. The temperature range in this procedure can be from room temperature to −140° C.

The system can also be utilized in other temperature ranges. With the use of an abrasive blasting device, not shown, acting on the region of the trough, any burrs present on the moldings are removed. The burr residues and the abrasive medium drop, during revolution, through the interstices in the braided web 1 into a funnel 8 where they can be removed and separated from each other so that the abrasive medium can be recovered. Charging and unloading of the illustrated facility takes place via a flap 9. The facility proper is noise-insulated.

Figure 2:
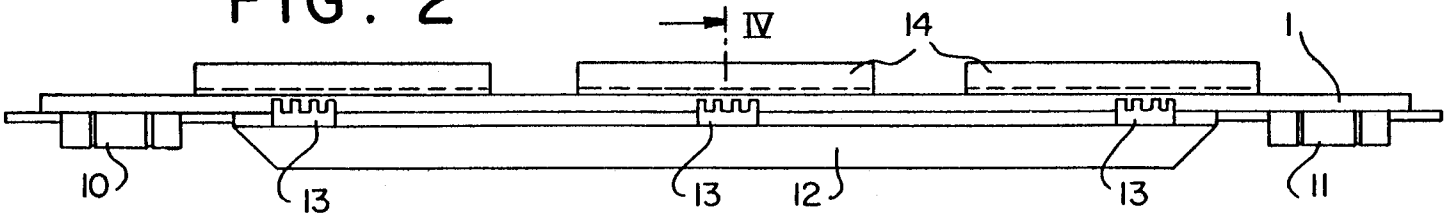
FIG. 2 is a front view of the conveyor belt used with the facility of FIG. 1.
Figure 3:
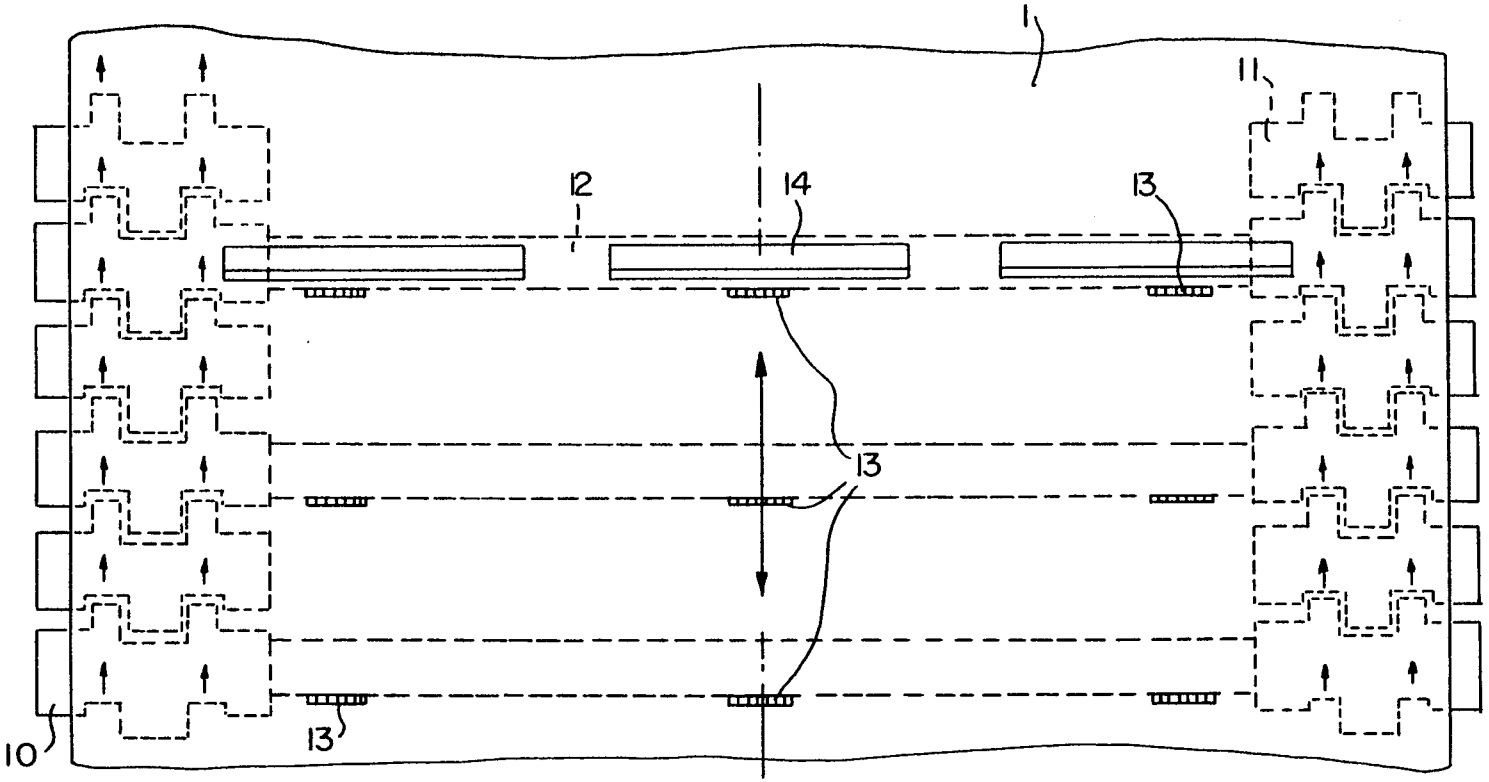
FIG. 3 is a top view of the conveyor belt used with the facility of FIG. 1.
Figure 4:
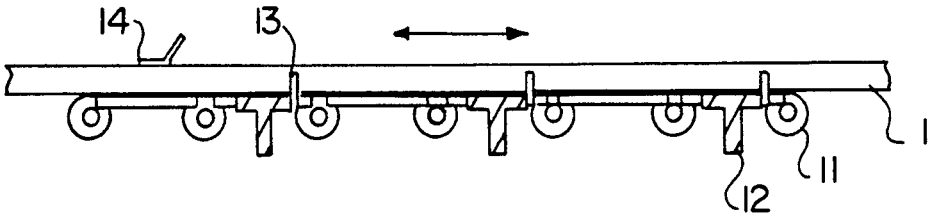
FIG. 4 is a section of the conveyor belt of FIGS. 2 and 3, taken along lines IV—IV.

FIGS. 2–4 show the belt conveyor system according to this invention. the braided web 1 rests on the left-hand and right-hand rims on two hinged belt chains 10 and 11. The hinged belt chains 10 and 11 are arranged in parallel with one another and are connected by a plurality of crossbars 12 preferably welded thereto. The crossbars 12 have a T-cross section and support the braided web 1 adjacent its edges. The top leg of the T forming the cross-member abuts the surface of the braided web 1 while the other leg of the T extends perpendicularly to the braided web. The hinged web chains 10 and 11 are driven by means of the drive wheels 2 (FIG. 1). Several dogs 13 are attached to each crossbar 12 with the dogs 13 extending perpendicularly from the top leg of the T and projecting into the interstices of the braided web 1. However, it is also possible to attach the dogs 13 only to each second or third crossbar. The dogs 13 are fashioned as combs and are fixed to the crossbars 12 by welding. The adaptation between the braided web 1 and the conveying wheels consisting of the crossbars and the hinged belt chains 10 and 11 is brought about by correspondingly adapted dogs 13. It is also possible to fashion the crossbars 12 to be exchangeable for this purpose. The operating direction of the hinged belt chains 10 and 11, indicated by arrows, is transmitted by the dogs 13 onto the braided web 1. During unloading, the braided web 1 moves in the opposite direction (counterclockwise in FIG. 1). Angle irons 14 are mounted on the braided band 1 and extend transversely to the direction of movement of this band. The angle irons provide for improved turning over of the moldings on the braided web 1. The dogs 13 which form entrainment means and the angle irons 14 can likewise be attached to the braided web 1 by welding since the braided web is made of steel.

It can be seen from FIG. 3 that the dogs 13 are in each case attached to the transverse arm of the crossbars 12 with T-shaped profile, and engage into the braided web 1 and thus are joined to the latter in a shape-mating fashion. The braided web 1 rests on the hinged belt chain 11 as well as on the crossbars 12. In principle, other suitable means can likewise be employed as the traction device in place of the hinged belt chains.

Without further elaboration, it is believed that one skilled in the art can, using the preceding description, utilize the present invention to its fullest extent. The preferred specific embodiments are, therefore, to be construed as merely illustrative, and not limitative of the remainder of the disclosure in any way whatsoever.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A belt conveyor system utilizing a conveyor belt fashioned as a braided web comprising a rotating conveyor means (10, 11, 12) including spaced parallel chains (10, 11) joined to one another by a plurality of crossbars (12); the braided web being comprised of a wire mesh connected to the conveyor means (10, 11, 12) in a shape-mating fashion by means of a plurality of dogs (13) each configured as a comb and welded in spaced relation with respect to one another to the crossbars (12), the dogs each projecting into and each being welded to the braided web (1).

2. The belt conveyor system according to claim 1, wherein the system is included in a troughed-belt, abrasive blast deburring facility.

3. A belt conveyor system comprising:

a trough wheel means;

a conveyor belt configured as a braided web and trained around at least a portion of the trough wheel means to define a closed trough therewith;

means for holding the braided conveyor belt in engagement with the portion of the trough wheel means;

a pair of parallel chains joined to one another by a plurality of crossbars having ends fixed to the chains, the chains being trained around at least a portion of the of the trough wheel means; and a plurality of dogs welded to each crossbar projecting into and welded to the braided web to positively couple the braided web with the pair of parallel chains.

4. The belt conveyor system of claim 3, wherein the dogs are comb-shaped elements with teeth that project into the braided web.

5. The belt conveyor system of claim 4, wherein the crossbars are T-shaped in cross-section with a first member forming the crossbar being positioned flat against the braided web and the second member forming the crossbar projecting perpendicularly from the braided web; the dogs being welded to an edge of the first member and projecting perpendicularly therefrom into the braided web.

6. A belt conveyor system used for a troughed-belt abrasive blast deburring facility wherein the conveyor belt is fashioned as a braided web of wire mesh comprising a rotating conveyor means (10, 11, 12) including spaced parallel chains (10, 11) joined to one another by a plurality of crossbars (12); the braided web being connected to the conveyor means (10, 11, 12) in a shape-mating fashion by means of a plurality of dogs (13) each configured as combs welded in spaced relation with respect to one another on each of the crossbars (12), the dogs each projecting into and each being welded to the braided web (1) and the braided web being held in engagement with a trough wheel in which deburring is accomplished.

7. A belt conveyor system used for a troughed-belt, abrasive blast deburring facility comprising:

a trough wheel means;

a conveyor belt configured as a braided web and trained around at least a portion of the trough wheel means to define a closed trough therewith in which trough deburring is accomplished;

means for holding the braided conveyor belt in engagement with the portion of the trough wheel means;

a pair of parallel chains joined to one another by a plurality of crossbars having ends fixed to the chains, the chains being trained around at least a portion of the of the trough wheel means; and a plurality of dogs welded on each crossbar projecting into and welded to the braided web to positively couple the braided web with the pair of parallel chains.

8. The belt conveyor system of claim 7, wherein the dogs are comb-shaped elements with teeth that project into the braided web.

9. The belt conveyor system of claim 7, wherein the crossbars are T-shaped in cross-section with a first member forming the crossbar being positioned flat against the braided web and the second member forming the crossbar projecting perpendicularly from the braided web; the dogs being welded to an edge of the first member and projecting perpendicularly therefrom into the braided web.

* * * * *